US012389977B2

(12) United States Patent
Markov

(10) Patent No.: US 12,389,977 B2
(45) Date of Patent: Aug. 19, 2025

(54) SLIP-RESISTANT SHOE COVER

(71) Applicant: Nikolay Markov, Suwanee, GA (US)

(72) Inventor: Nikolay Markov, Suwanee, GA (US)

( * ) Notice: Subject to any disclaimer, the term of this patent is extended or adjusted under 35 U.S.C. 154(b) by 0 days.

(21) Appl. No.: 18/482,895

(22) Filed: Oct. 8, 2023

(65) Prior Publication Data

US 2025/0113893 A1 Apr. 10, 2025

(51) Int. Cl.
*A43B 3/16* (2022.01)

(52) U.S. Cl.
CPC ..... *A43B 3/16* (2013.01)

(58) Field of Classification Search
CPC ..... A43B 3/16; A43B 5/18
USPC ..... 36/7.1 R
See application file for complete search history.

(56) References Cited

U.S. PATENT DOCUMENTS 4,083,124 A * 4/1978 Michalak ..... A43B 3/16 36/7.1 R
4,825,564 A * 5/1989 Sorce ..... A43B 3/02 36/7.1 R
5,228,215 A * 7/1993 Bayer ..... A43B 3/18 36/7.7
6,833,171 B2 * 12/2004 Campbell ..... A43B 3/16 36/7.7
9,078,492 B2 * 7/2015 Koo ..... A43B 13/12
2008/0052957 A1 * 3/2008 Taheri ..... A43B 5/18 36/73
2008/0264320 A1 * 10/2008 Harward ..... B29C 65/08 112/475.17
2021/0186161 A1 * 6/2021 Miller ..... A43B 3/16

* cited by examiner

*Primary Examiner* — Timothy K Trieu

(57) ABSTRACT

Exemplary embodiments include a slip-resistant shoe cover comprising: a body shaped to surround the wearer's foot, the body having an outside surface designed to contact the ground when the slip-resistant shoe cover is being worn; and a slip-resistant fabric strip ultrasonically welded to the outside surface. Exemplary methods include a method of forming a slip-resistant shoe cover, comprising: cutting a blank from a fabric for forming a shoe cover body, the bottom portion of the shoe cover body having an outside surface designed to contact the ground when the shoe covers is being worn; cutting a blank from a slip-resistant fabric suitable for forming a slip-resistant strip; folding the blank in half to define a center; overlapping the slip-resistant strip with the bottom portion of the shoe cover body's outside surface; and ultrasonically welding the slip-resistant fabric strip to the shoe cover body's outside surface.

14 Claims, 4 Drawing Sheets

SLIP-RESISTANT SHOE COVER

BACKGROUND OF THE INVENTION

The present invention relates to shoe covers having slip-resistant properties. The shoe covers are generally made of a variety of fabric substrates, such as woven reusable fabrics and nonwoven disposable fabrics, e.g. polypropylene fabric. In general, most readily available fabrics lack slip-resistant properties. There are some fabrics that have slip-resistant properties, but they are more rigid and more expensive, thus not the best solution for softness, comfort, and low cost. Disposable shoe covers must be relatively inexpensive due to their application. The need for one-time use shoe covers is greater in hospitals and operating rooms, where preventing contamination or keeping sterilized environment is important. However, shoe covers are used indoors on different surfaces in many different residential and commercial settings. Those surfaces can be smooth and slippery, posing a serious safety hazard. Since shoe covers are put over the shoes of the wearer, the only grip left once they are put on is the grip coming from the shoe cover material.

When making reusable shoe covers, manufacturers have used different rubberized materials for the sole portion of the shoe cover and another less expensive material for the uppers of the shoe cover. This design is normally costly and requires cutting separate blanks in different shapes and sewing the blanks together, which makes it not suitable for manufacturing disposable shoe covers. One of the biggest challenges that a manufacturer of disposable shoe covers faces ismaking disposable shoe covers that have slip-resistant properties at a low cost. In the past, manufacturers have tried different methods to make slip-resistant disposable shoe covers, but none of the known methods provides an optimal solution that balances cost, performance, and production speed, while using readily available materials.

One method to make slip-resistant disposable shoe covers is to make a blank from nonwoven fabric that has slip-resistant properties and form the entire shoe cover from the same fabric material. Although this method works to some degree, the fabric cost is quite high. Since the slip-resistant properties are only necessary at the bottom portion of the shoe cover, which contacts the ground, the rest of the fabric slip-resistant properties are never used but are paid for by the manufacturer and the end user. In addition, adding slip-resistant properties to a fabric normally makes the fabric more rigid, which can make the shoe cover uncomfortable and noisy.

Another method used to make slip-resistant shoe covers is by sewing an exposed rubber rib to the bottom portion of the shoe cover. This method provides some slip resistance, but its effect is limited by the width of the rubber rib. The wider the rib, the better the slip-resistance of the shoe covers. However, increasing the width of the rubber rib can make the shoe cover uncomfortable and costly. Since the rubber rib is exposed and designed to contact the ground, the shoe cover user will be stepping over the rubber, which can be very uncomfortable. In addition, the cost of the rubber rib can be as much as or more than the whole shoe cover blank. Also, this method is time consuming and involves extra sewing steps.

A third method of making slip-resistant disposable shoe covers is by printing, painting, or spraying various patterns on the bottom section of the shoe covers. These methods are time consuming, costly, require a high-volume production, and the slip-resistance effect is limited. In many instances the print on the bottom of the shoe cover does not provide any grip and it is just a visual appearance. There are some PVC (rubber) based inks that can provide a good grip, but the cost for such prints is very high and much more than the entire shoe cover.

Another known method of making slip-resistant shoe covers is by applying different polymers that have slip resistant properties in various patterns directly on to a nonwoven fabric being used to make the shoe cover body. Those polymers are designed to adhere to the substrate materials and may require additional consumables, such as adhesives and glues. The polymers used are often proprietary to the companies that make them and require large purchasing volumes and significant investment for the application process in order to be automated. Also, the slip-resistant effect and the durability are somewhat limited.

There is a need for slip-resistant shoe cover that is low in cost, comfortable, quick to manufacture and makes use of readily available materials.

SUMMARY OF THE INVENTION

The shoe cover in exemplary embodiments of this invention solves the problem of manufacturing slip-resistant shoe covers by ultrasonically welding a slip-resistant fabric strip, pre-cut to a desired width from a fabric with slip-resistant properties, to another less expensive fabric that does not have slip-resistant properties. The shoe cover according to exemplary embodiments comprises of a body shaped to surround the foot of the wearer. The body is made of a fabric comprising an inside surface and an outside surface, the outside surface designed to contact the ground when the shoe cover is being worn, and a slip-resistant fabric strip, pre-cut to a desired width from a different fabric that has non-slip properties, ultrasonically welded to the bottom outside surface of the shoe cover.

Another aspect of the present invention relates to a method of making slip-resistant shoe cover comprising ultrasonically welding of a fabric strip with slip-resistant properties to another fabric without slip-resistant properties, the latter used to form the body of the shoe cover. The body of the shoe cover comprises an inside surface and an outside surface. The inside surface of the shoe cover is designed to contact the wearer's shoe and the outside surface is designed to contact the floor or ground. The slip-resistant fabric strip is ultrasonically welded to the bottom outside surface of the shoe cover.

Ultrasonic welding is the joining of two or more substrates through the use of heat generated from high-frequency mechanical motion. It is accomplished by converting high-frequency electrical energy into high-frequency mechanical motion. Pressure is applied to two or more overlapping fabrics to create friction. Friction produces heat and melts the two fabrics at one or more contact points. Once cooled down, a solid homogeneous weld between the two fabrics is created. The ultrasonic welding process is easy and quick to setup, consumes low energy, and has high productivity speed.

BRIEF DESCRIPTION OF THE DRAWINGS

These and other features, aspects, and advantages of the present invention will become better understood with reference to the following description, appended claims, and accompanying drawings, where:

DETAILED DESCRIPTION

Figure 1:
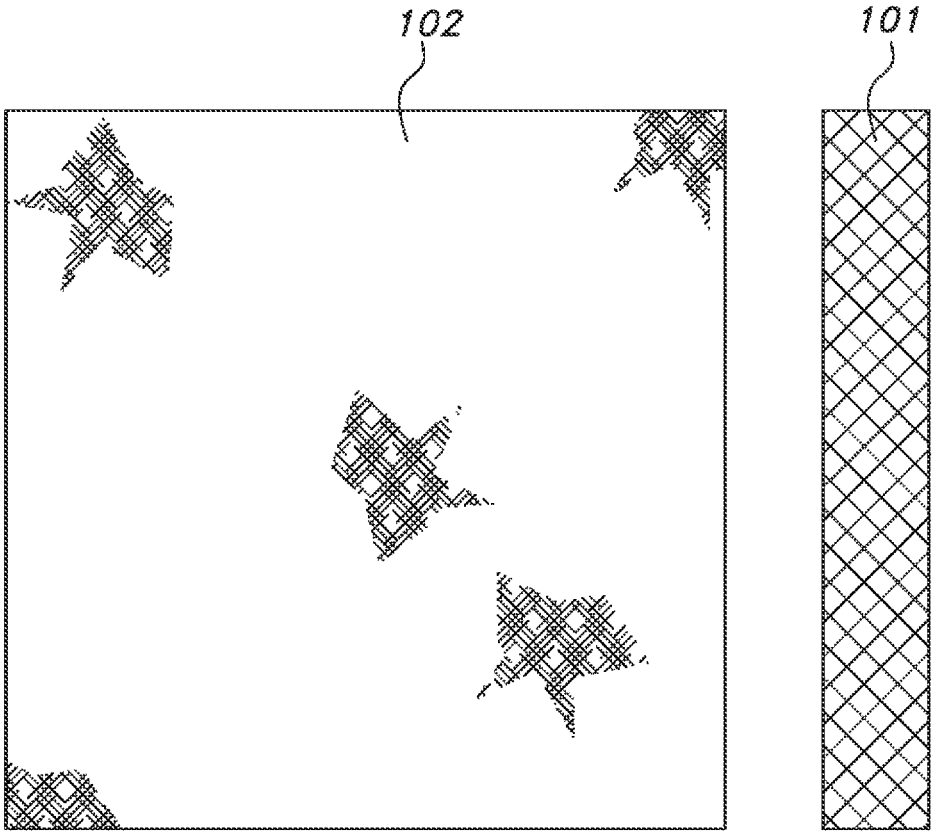
FIG. 1 is a front view of a blank cut from a fabric material without slip-resistant properties and a strip cut from a fabric with slip-resistant properties, all to be used to form an exemplary shoe cover of the present invention.

FIG. 1 shows the components for forming the shoe cover in exemplary embodiments. A blank 102 can be cut from a low cost fabric suitable for manufacturing of shoe covers. For example, almost any fabric woven or nonwoven can be used. FIG. 1 also shows a blank strip 101 that can be cut from any woven or nonwoven fabric that has slip-resistant properties. Other fabrics can be used for the current invention but in general fabrics with similar chemistry and high synthetic fiber content will weld together better than fabrics with different chemistry and low synthetic fiber content. In preferred embodiments, fabric should have 60% or more synthetic fiber content in order to be welded together. In addition, in preferred embodiments, melt temperature difference for dissimilar materials should not be greater than 50° F. Due to the relatively low cost and durability, nonwoven disposable fabrics formed by different processes, such as spunbonding or meltblowing are most suitable for the present invention. The basic weight of nonwoven fabrics is usually expressed in grams per square meter (gsm). Nonwoven fabrics with weight between 30 grams per square meter and 80 grams per square meter are most suitable for the present invention.

Figure 2:
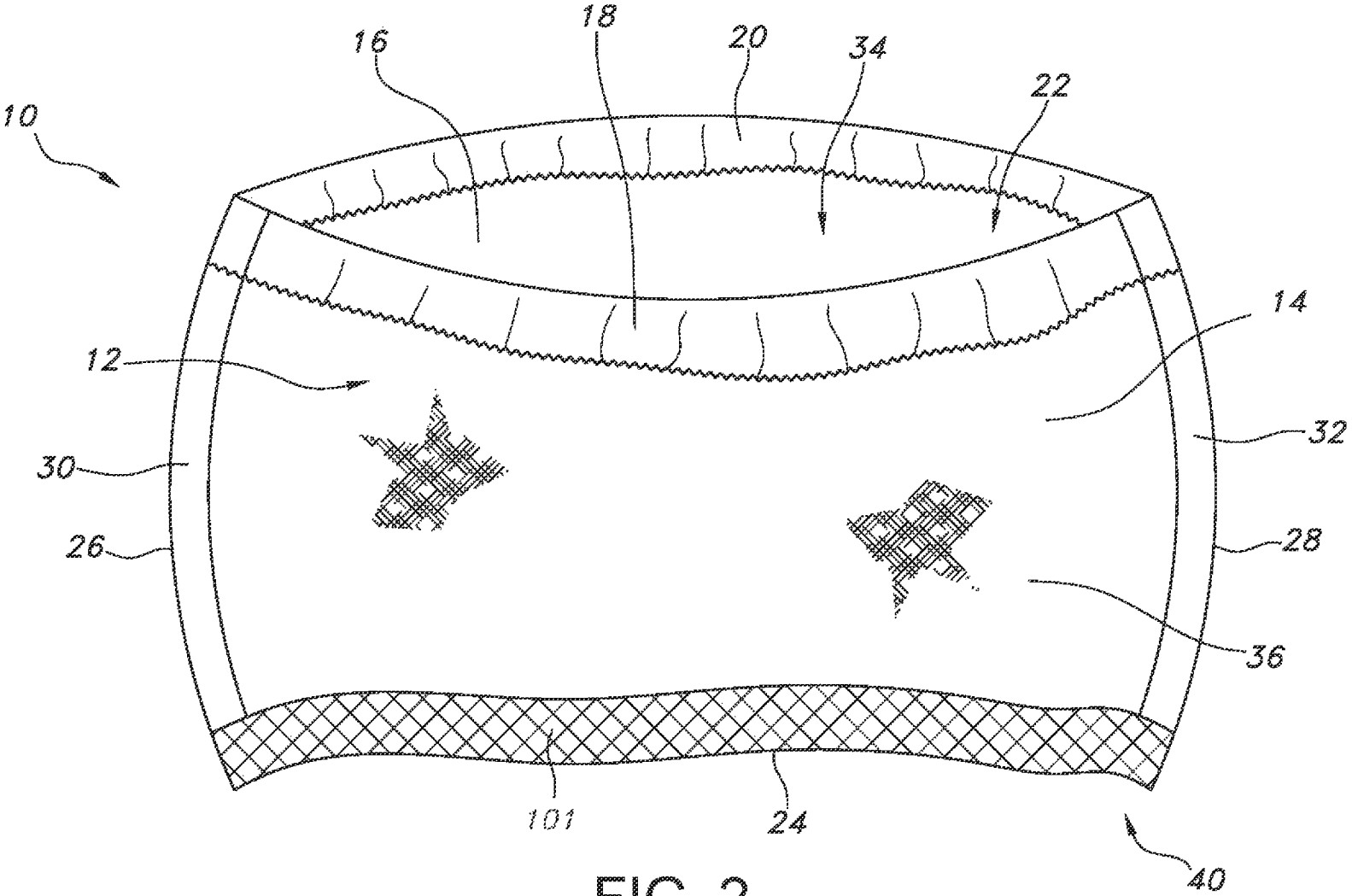
FIG. 2 is s a side view of an exemplary shoe cover of this invention showing the outside surface of the shoe cover made in accordance with exemplary methods of the present invention.

Referring to FIG. 2 an example shoe cover 10 is illustrated. The shoe cover 10 includes a body 12 formed by folding the material to create two side panels 14 and 16. The panels 14 and 16 include top elastic hems 18 and 20, respectively, formed by ultrasonic welding. The top elastic hems 18 and 20 define an opening 22 for receiving a shoe (not shown). The top elastic hems include a strip of elastic material (not shown). The panels 14 and 16 are folded to form a bottom fold 24, which defines the center, and side edges 26 and 28. The side edges 26 and 28 are ultrasonically welded to form welding joints 30 and 32, respectively, and a bottom portion 40. Each panel includes an inside surface 34 and outside surface 36. The opening 22 is expandable to form fitting about the wearer's ankle.

In accordance with exemplary embodiments, the shoe cover 10 further includes a slip-resistant fabric strip 101 located on the bottom portion 40 and overlapping with the bottom fold 24 along the entire length of the shoe cover. The slip-resistant fabric strip is ultrasonically welded over the bottom fold 24. The slip resistant fabric strip 101 can be formed from any available nonwoven or woven fabric coated, bonded or laminated with various polymers such as Acrylics, Polyurethane, Nylon, Polyethylene, Polyvinyl Chloride, or any other polymer that provides slip resistance to the finished material. In general, fabrics are made from synthetic fibers (manufactured), natural fibers (occur in nature) or combination of both. In preferred embodiments, the fabric being used to form the slip-resistant strip 101 has a composition of 60% or more synthetic fibers in order to be weldable. The slip-resistant fabric strip 101 works best when it has a width from 2 centimeters to 6 centimeters and it is positioned along the bottom fold 24. The slip-resistant fabric strip 101 can be any desired width and can be positioned anywhere along the bottom portion of the shoe cover 40 that is designed to contact the ground. It should also be noted that a plurality of slip-resistant fabric strips can be ultrasonically welded along the bottom portion 40 of the shoe cover 10.

Figure 3:
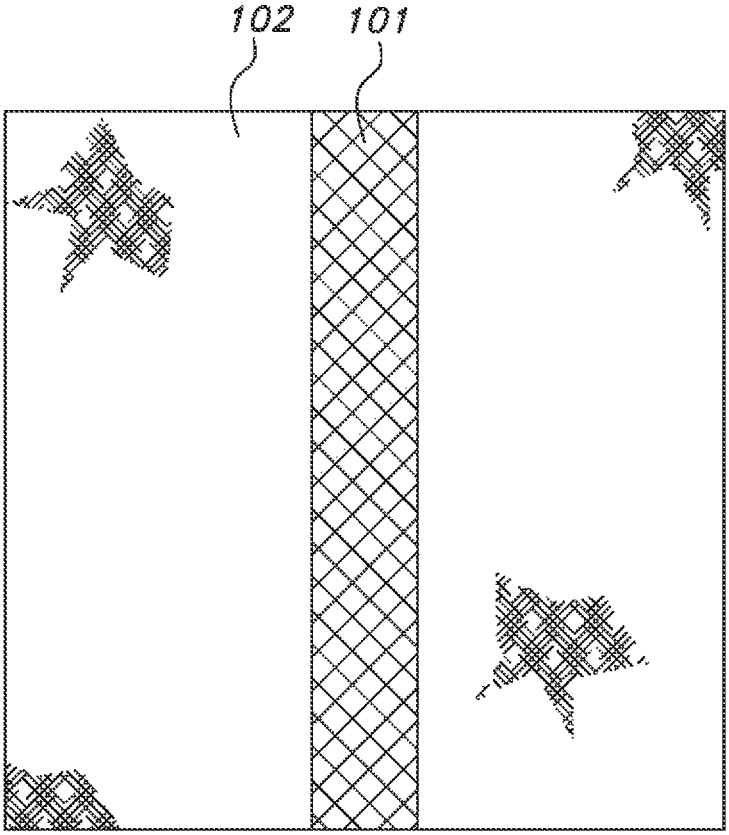
FIG. 3 illustrates overlapping of the two different fabrics, used in exemplary embodiments to make the present invention.
Figure 4:
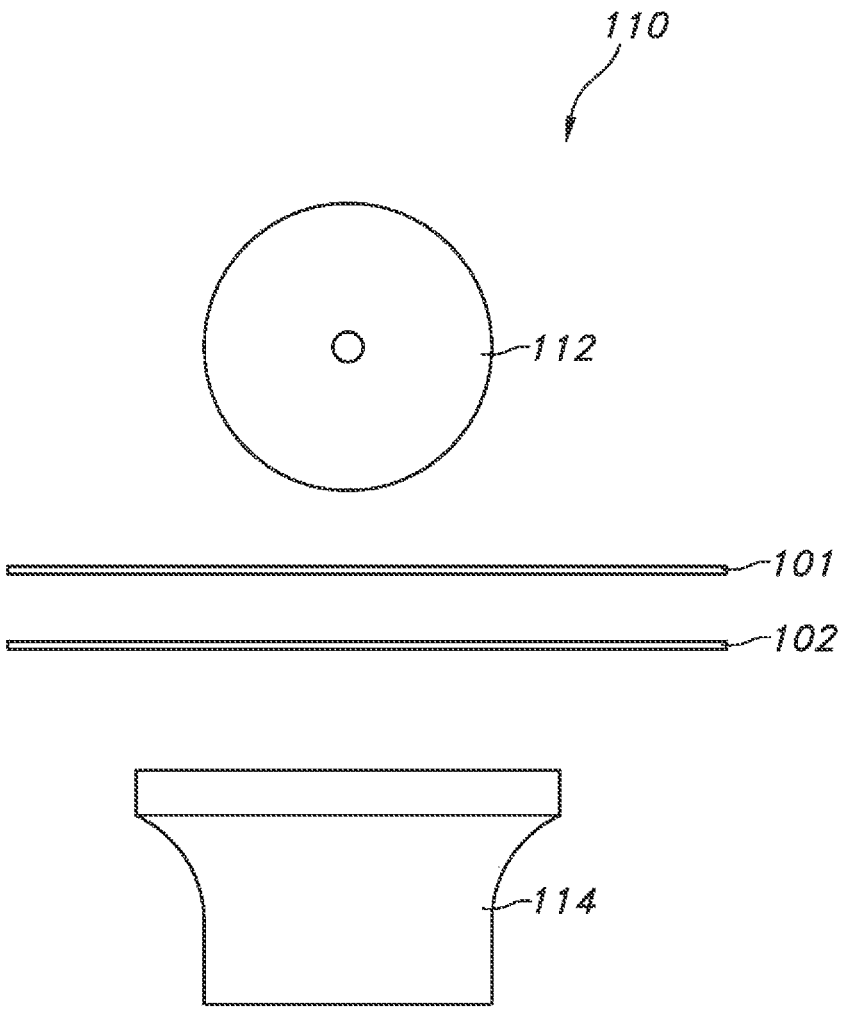
FIG. 4 illustrates the process of joining two different fabric materials according to an example of the disclosed technology.

FIG. 3 illustrates an exemplary slip-resistant fabric strip 101 and fabric blank 102, which are overlapped and placed in an ultrasonic welding tool 110, as shown in FIG. 4. Elastic strip (not shown) can be placed between the slip-resistant fabric strip 101 and fabric blank 102 for a snug fit of the present invention. As seen in FIG. 4, the ultrasonic welding tool 110 includes welding wheel 112 and a horn transducer 114. The horn transducer 114 produces ultrasonic vibrations, and pressure is applied to the welding wheel 110 and the two fabrics 101 and 102 to create friction. Friction produces heat and melts the two fabrics at one or more contact points to form and ultrasonic welding joint as one skilled in art will understand.

There are many advantages in the shoe cover of this invention having an ultrasonically welded slip-resistant strip 101 along the bottom portion 40 of the shoe cover 10.

For example, nonwoven fabrics with slip-resistant properties are 3 to 4 times more expensive than nonwoven fabrics without any slip-resistant properties. By ultrasonically welding just a small slip-resistant strip along the bottom portion of the shoe cover, the incremental cost increase of adding slip-resistance to the shoe cover is very minimal as compared to other solutions described in the background section. This invention gives the manufacturers options to experiment with various readily available fabrics and find the one that best suit their needs when trying to achieve a balance between cost and safety. Slip-resistance is measured on a scale based on Coefficient of Friction (COF). The Coefficient of Friction is the ratio of the frictional force resisting the motion of two surfaces in contact to the normal force pressing the two surfaces together. By increasing the width or the count of the slip-resistant fabric strip 101 manufacturers can easily increase or decrease the COF of the shoe cover of the present invention while having control over the cost.

Furthermore, when the slip-resistant fabric strip 101 and the fabric blank 102 are overlapped and placed in an ultrasonic welding tool 110 a uniform joint is formed. This ultrasonically welded joint keeps the shoe cover bottom portion 40 of the present invention flat and much more comfortable when compared to other solutions.

Third, since the slip-resistant fabric strip 101 is ultrasonically welded the need for additional consumables, adhesives, glue, inks, or polymers is eliminated. Also, the ultrasonic welding process is easy and quick to setup and consumes low energy.

Fourth, the ultrasonic welding process also eliminates the need of stitching, which creates holes in the shoe cover and allows water or other liquids to penetrate the material quicker.

Another advantage of the present invention is the ability to automate the production process of slip-resistant shoe covers. The blanks 101 and 102 can be cut individually as shown on FIG. 1 or used as rolled fabrics slid to a desired width and fed into an ultrasonic welding device. The blanks 101 and 102 can be placed on rolls, cut to the desired width and fed into ultrasonic welding machine for fast and automated production. Currently, there are many ultrasonic welding machines on the market that can perform all the necessary steps of forming the slip-resistant shoe cover of the present invention. The machines are versatile and easy to use in order to seam, cut, slit, trim, tack, emboss, or to cut and seal at the same time. The ultrasonic welding process is easy and quick to setup and has high productivity speed.

What is claimed is:

1. A slip-resistant shoe cover comprising: a shoe cover body shaped to surround a foot of a wearer, the body made from a first fabric lacking inherent slip-resistant properties. the first fabric comprising at least 60% synthetic fibers and having a weight ranging from 30 to 80 grams per square meter, the body having an inside surface and an outside surface, the outside surface intended to contact the ground when the shoe cover is worn; and a slip-resistant fabric strip ultrasonically welded to the outside surface of the body, the fabric strip formed from a second fabric with in-resistant properties. the second fabric comprising at least 60% synthetic fibers and having a weight ranging from 30 to 80 grams per square meter; wherein the fabric used to form the shoe cover body and the fabric used to form the slip-resistant fabric strip have a melt temperature difference of not greater than 50° F.; wherein the slip-resistant fabric strip is made of nonwoven or woven coated or laminated with various of polymers.

2. The slip-resistant shoe cover of claim 1, wherein the slip-resistant fabric strip has a width ranging from about 2 centimeters to about 6 centimeters.

3. The slip-resistant shoe cover of claim 1, wherein the shoe cover body and the slip-resistant fabric strip are formed from different nonwoven fabrics.

4. The slip-resistant shoe cover of claim 1, wherein a plurality of slip-resistant fabric strips are ultrasonically welded to the outside surface of the body.

5. The slip-resistant shoe cover of claim 1, wherein the shoe cover body and the slip-resistant fabric strip form a flat, uniform joint when ultrasonically welded.

6. The slip-resistant shoe cover of claim 1, wherein the shoe covers is formed without the use of adhesives.

7. The slip-resistant shoe cover of claim 1, wherein the tant strip is formed from nonwoven fabric with slip-resistant properties.

8. A method of imparting slip-resistant properties to a shoe cover, comprising: providing a shoe cover having a body shaped to surround a foot of a wearer, the body made from a first fabric lacking inherent slip-resistant properties, the first fabric comprising at least 60% synthetic fibers and having a weight ranging from 30 to 80 grams per square meter inside surface and an outside surface, the outside surface designed to contact the ground when the shoe cover is being worn; and ultrasonically welding a slip-resistant fabric strip to the outside surface of the shoe cover body, the fabric strip formed from a second fabric having slip-resistant properties, the second fabric comprising at least 60% synthetic fibers and having a weight ranging from 30 to 80 grams per square meter, wherein the ultrasonic welding of the slip-resistant fabric strip to the shoe cover body provides slip-resistant properties to the shoe cover; wherein the fabric used to form the shoe cover body and the fabric used to form the slip-resistant fabric strip have a melt temperature difference of not greater than 50° F.; wherein the slip-resistant fabric strip is made of nonwoven or woven coated or laminated with various of polymers.

9. The method of claim 8, wherein the slip-resistant fabric strip has a width ranging from about 2 centimeters to about 6 centimeters.

10. The method of claim 8, wherein the shoe cover body and the slip- resistant fabric strip are formed from different nonwoven fabrics.

11. The method of claim 8, wherein a plurality of slip-resistant fabric strips are ultrasonically welded to the outside surface of the body.

12. The method of claim 8, wherein the shoe cover body and the slip-resistant fabric strip form a flat, uniform joint when ultrasonically welded.

13. The method of claim 8, wherein the slip-resistant fabric strip is attached to the shoe cover body without the use of adhesives.

14. The method of claim 8, wherein the slip-resistant strip is formed from nonwoven fabric with slip-resistant properties.

* * * * *